US011859473B2

(12) United States Patent
Al Hashim et al.

(10) Patent No.: US 11,859,473 B2
(45) Date of Patent: Jan. 2, 2024

(54) AUTOMATIC IN-SITU GAS LIFTING USING INFLOW CONTROL VALVES

(71) Applicant: SAUDI ARABIAN OIL COMPANY, Dhahran (SA)

(72) Inventors: Hassan Wasel Al Hashim, Ad Dammam (SA); Ali Saleh Rabaa, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 399 days.

(21) Appl. No.: 17/094,242

(22) Filed: Nov. 10, 2020

(65) Prior Publication Data

US 2022/0145734 A1 May 12, 2022

(51) Int. Cl.

| | |
|---|---|
| ***E21B 43/12*** | (2006.01) |
| ***E21B 41/00*** | (2006.01) |
| ***E21B 43/14*** | (2006.01) |
| ***E21B 47/06*** | (2012.01) |

(52) U.S. Cl.

CPC ..... *E21B 43/122* (2013.01); *E21B 41/0035* (2013.01); *E21B 43/14* (2013.01); *E21B 47/06* (2013.01)

(58) Field of Classification Search

CPC ..... E21B 41/0035; E21B 43/14; E21B 47/06; E21B 43/122; E21B 43/13; E21B 43/123; E21B 43/1235

See application file for complete search history.

(56) References Cited

U.S. PATENT DOCUMENTS

| | | | |
|---|---|---|---|
| 6,983,804 | B2 | 1/2006 | Ellepola et al. |
| 8,290,632 | B2 | 10/2012 | Briers et al. |

(Continued)

FOREIGN PATENT DOCUMENTS

| | | | |
|---|---|---|---|
| RU | 2279539 | C2 | 7/2006 |
| WO | 2017065863 | A1 | 4/2017 |
| WO | 2019110851 | A1 | 6/2019 |

OTHER PUBLICATIONS

Betancourt, S. et al., "Natural Gas-Lift: Theory and Practice", SPE 74391, Society of Petroleum Engineers Inc., Feb. 2002 (7 pages).

(Continued)

*Primary Examiner* — Kristyn A Hall

(74) *Attorney, Agent, or Firm* — Osha Bergman Watanabe & Burton LLP

(57) ABSTRACT

A system for automatic in-situ gas lifting of fluid in a multilateral well may include a plurality of downhole sensors arranged to periodically capture pressure data associated with the multilateral well is disclosed. The system may include a processor operatively connected to the downhole sensors and configured to dynamically determine a pressure gradient value associated with the multilateral well based on the periodically captured pressure data. The system may include a first inflow control valve (ICV) operatively connected to the processor and placed within a first lateral to automatically control a flow of a gas from a downhole natural gas source into the multilateral well based on the dynamically determined pressure gradient, and to cause a lift of the fluid received from a second lateral within the well when the ICV is open.

21 Claims, 8 Drawing Sheets

(56) References Cited

U.S. PATENT DOCUMENTS

| | | | | |
|---|---|---|---|---|
| 2005/0096848 | A1* | 5/2005 | Hou | E21B 21/085 702/9 |
| 2005/0155756 | A1 | 7/2005 | Vossler | |
| 2010/0217575 | A1 | 8/2010 | Briers et al. | |
| 2013/0087343 | A1 | 4/2013 | Juenke | |
| 2014/0251609 | A1* | 9/2014 | Broussard | E21B 34/102 166/278 |
| 2016/0145956 | A1* | 5/2016 | Dahl | E21B 23/12 166/117.6 |
| 2018/0171765 | A1 | 6/2018 | Elmer | |

OTHER PUBLICATIONS

Vasper, Adam, "Auto, Natural, or In-Situ Gas-Lift Systems Explained", SPE 104202, SPE Production & Operations, Society of Petroleum Engineers, Feb. 2008, pp. 75-80 (6 pages).

Warren, Phillip et al., "Utilization of In-Situ Gas Lift System to Increase Production in Saudi Arabia Offshore Oil Producers", SPE 120696, Society of Petroleum Engineers, Mar. 2009 (10 pages).

Al-Khelaiwi, F.T. et al., "Advanced Wells: A Comprehensive Approach to the Selection Between Passive and Active Inflow-Control Completions", SPE 132976, SPE Production & Operation, Society of Petroleum Engieers, Aug. 2010, pp. 305-326 (22 pages).

Frooqnia, A. et al., "Real Time Optimization of a Natural Gas Lift System with a Differential Evaluation Method", Energy Sources, Part A.: Recovery, Utilization, and Environmental Effects, Taylor & Francis Group, LLC, vol. 36, 2014, pp. 309-322 (14 pages).

International Search Report and Written Opinion issued in Application No. PCT/US2021/058739, dated Mar. 2, 2022 (14 pages).

M. Konopczynski et al.; "Intelligent-Well Technology Used for Oil Reservoir Inflow Control and Auto-Gaslift Offshore India", SPE 105706; Society of Petroleum Engineers; Mar. 14, 2007; pp. 1-7 (7 pages).

H. AlamiNia et al.; "Different Aspects of Natural Gas Lift Applications", Petroleum Technical Conference & Exhibition; vol. 1; May 1, 2013; pp. 1-8 (8 pages).

N. M. Al-Otaibi et al.; "Smart-Well Completion Utilizes Natural Reservoir Energy To Produce High-Water-Cut and Low-Productivity-Index Well in Abqaiq Field", SPE 104227; Society of Petroleum Engineers; Dec. 1, 2006; pp. 1-7 (7 pages).

* cited by examiner

AUTOMATIC IN-SITU GAS LIFTING USING INFLOW CONTROL VALVES

BACKGROUND

In the petroleum industry, the gas lift mechanism is used to sustain or increase the flow of fluids, such as crude oil, from a production well. Initially, hydrocarbons flow to the surface unaided when the reservoir energy is sufficient. As the water cut in the produced fluid increases over a period of time, the reservoir energy drops and may not be sufficient to overcome the hydrostatic pressure of the fluid column. The fluid flow to the surface ceases at this point.

The injection of gas from the surface into the production tubing reduces the density of the fluid column which, in turn, reduces the hydrostatic pressure. As a result, the fluid flow to the surface is restored. Conventionally, this process is known as "gas lift." Gas lift generally requires installation of capital-intensive gas compressors and downhole equipment in the form of mandrels and valves. This equipment requires frequent maintenance and optimization, which results in well and surface facility interruptions and production downtime.

Accordingly, there is a need for a system that provides improvements over the conventional gas lift systems by minimizing the need for equipment maintenance and the interruptions in the well operations and the surface facility.

SUMMARY

This summary is provided to introduce concepts that are further described below in the detailed description. This summary is not intended to identify key or essential features of the claimed subject matter, nor is it intended to be used as an aid in limiting the scope of the claimed subject matter.

In general, in one aspect, embodiments disclosed herein relate to a system for automatic in-situ gas lifting of fluid in a multilateral well. The system includes a plurality of downhole sensors arranged to periodically capture pressure data associated with the multilateral well. The system includes a processor operatively connected to the downhole sensors and configured to dynamically determine a pressure gradient value associated with the multilateral well based on the periodically captured pressure data. The system includes a first inflow control valve (ICV) operatively connected to the processor and placed within a first lateral to automatically control a flow of a gas from a downhole natural gas source into the multilateral well based on the dynamically determined pressure gradient, and to cause a lift of the fluid received from a second lateral within the well when the ICV is open.

In general, in one aspect, embodiments disclosed herein relate to a method for automatic in-situ gas lifting of fluid in a multilateral well. The method includes periodically capturing pressure data associated with the multilateral well using a plurality of downhole sensors. The method includes dynamically determining, using a processor, a pressure gradient value associated with the multilateral well based on the periodically captured pressure data. The method includes automatically controlling, using a first inflow control valve (ICV) placed within a first lateral, a flow of a gas from a downhole natural gas source into the multilateral well based on the dynamically determined pressure gradient. The method includes causing a lift of the fluid received from a second lateral within the well when the first ICV is open.

In general, in one aspect, embodiments disclosed herein relate to a non-transitory machine-readable storage medium comprising instructions that, when executed by one or more processors of a machine, cause the machine to perform operations. The operations include periodically capturing pressure data associated with the multilateral well using a plurality of downhole sensors. The operations include dynamically determining a pressure gradient value associated with the multilateral well based on the periodically captured pressure data. The operations include automatically controlling, using an inflow control valve (ICV) placed within a first lateral, a flow of a gas from a downhole natural gas source into the multilateral well based on the dynamically determined pressure gradient. The operations include causing a lift of the fluid received from a second lateral within the well when the ICV is open.

Other aspects and advantages of the claimed subject matter will be apparent from the following description and the appended claims.

BRIEF DESCRIPTION OF DRAWINGS

Some embodiments are illustrated by way of example and not limitation in the figures of the accompanying drawings.

DETAILED DESCRIPTION

Figure 1:
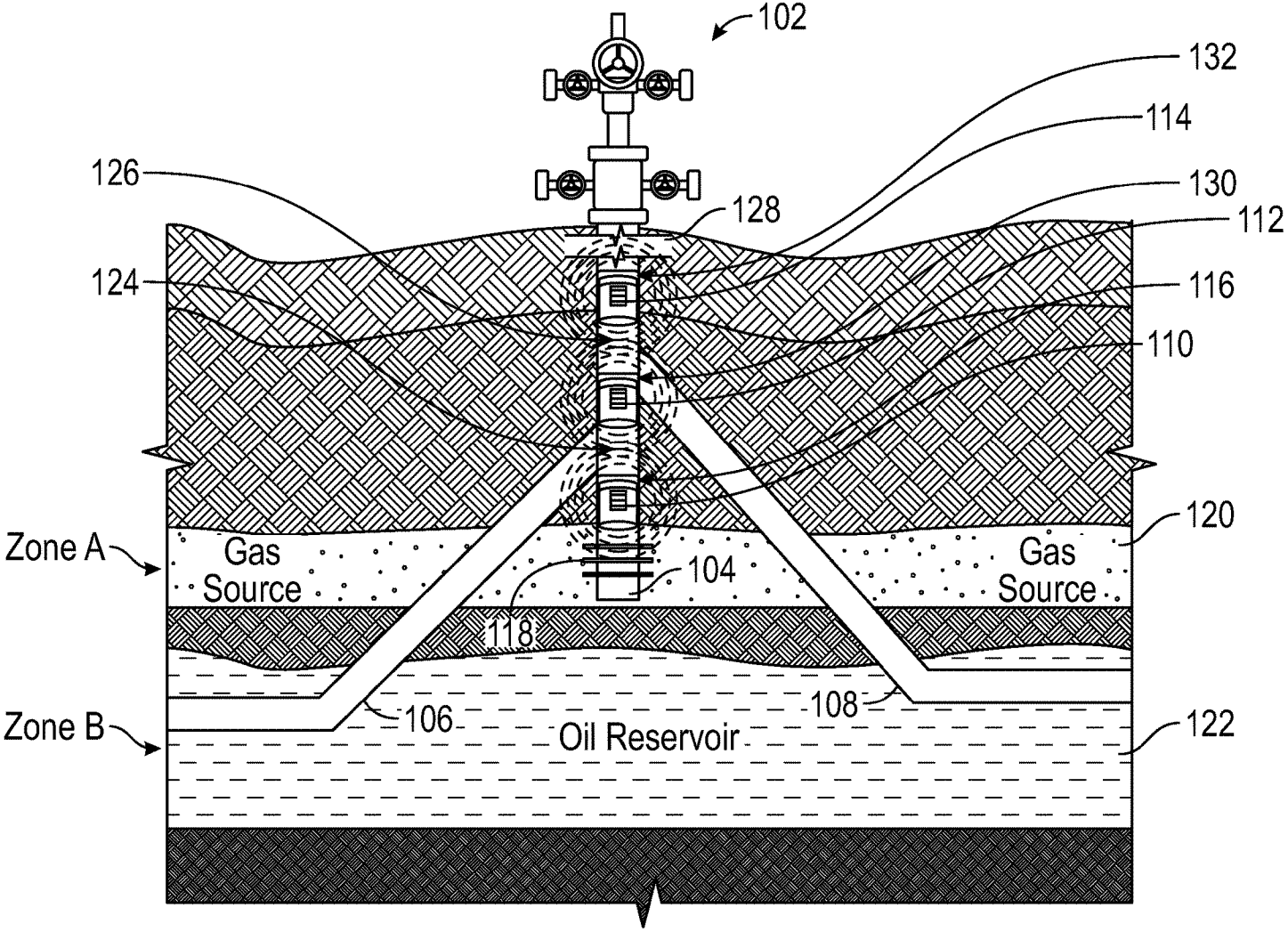
FIG. 1 is a schematic illustration of a multilateral well environment, according to one or more example embodiments.

Example systems and methods for automatic in-situ gas lifting in a multilateral well using inflow control valves are described. Unless explicitly stated otherwise, components and functions are optional and may be combined or subdivided. Similarly, operations may be combined or subdivided, and their sequence may vary.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, or third) may be used as an adjective for an element (that is, any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

Generally, oil wells cease to flow when the reservoir energy is not sufficient to overcome the hydrostatic pressure exerted by the fluid column. As the water cut in the produced fluid increases over a period of time or the reservoir pressure drops, the reservoir energy may not be sufficient to overcome the hydrostatic pressure of the fluid column. Typically, to revive the well, gas is injected from the surface into the production tubing in order to reduce the density of the fluid column, which in turn reduces the hydrostatic pressure of the fluid column and forces the fluid to flow to the surface. However, this traditional approach to gas lifting results in frequent operational interruptions caused by equipment maintenance.

A system for automatic in-situ gas lifting in a multilateral well using inflow control valves (hereinafter also "ICVs") provides improvements over the conventional gas lift systems by minimizing the need for equipment maintenance and the interruptions in the operations of the well and the surface facility. The in-situ gas lifting system may include a completion scheme that enables the utilization of multiple wellbores in an oil well. The multiple wellbores in such an oil well may be vertical, horizontal, at an angle, or a combination thereof. Such multiple wellbores in an oil well are also called "wellbore branches," "lateral wellbores," or simply "laterals." The completion scheme that enables the utilization of multiple wellbores in the oil well may be called a "multilateral well."

A multilateral well with access to a downhole natural gas source via one or more of the laterals may utilize the gas from the downhole natural gas source to lighten the fluid column. This allows the prolonging of the life of the well by sustaining the oil production or facilitating additional oil production from the well without relying on an artificial injection of gas. The in-situ gas lifting system automatically actuates one or more ICVs based on a fluid pressure gradient value determined using pressure data captured by sensors placed upstream of the one or more ICVs within the multilateral well.

In addition to the advantages stemming from the use of a gas from a natural source without relying on an artificial gas injection to cause the flow of oil in the multilateral well, the in-situ gas lifting system provides the benefit of restricting or stopping the gas production, when desired, by hydraulically or electrically adjusting or closing the ICV located in the lateral connected to the gas source. This allows for an enhanced control of the well production and equipment.

FIG. 1 is a schematic illustration of a multilateral well environment, according to one or more example embodiments. The well environment 100 includes a well 102 extending from the surface into a target zone of a formation, such as an oil reservoir 122. In FIG. 1, the oil reservoir 122 is also identified as Zone B. Zone B is an under-saturated oil zone. Although the discussion of FIG. 1 hereafter talks about an oil reservoir 122, those of ordinary skill in the art will appreciate that the reservoir may also be a gas reservoir.

The well 102 is a multilateral well which includes a plurality of lateral wellbores (hereinafter also "laterals"), such as laterals 104, 106, and 108. The laterals may be horizontal, vertical, at an angle, or a combination thereof. The laterals 106 and 108 are placed across the oil reservoir 122. The oil reservoir 122 is under-saturated. The lateral 104 is placed across a gas condensate or volatile oil source 120, identified as Zone A in FIG. 1 (hereinafter also "the gas source 120," "the gas zone," or "the gas source").

In some example embodiments, each lateral is equipped with an inflow control valve (hereinafter also "ICV") to facilitate and control the flow from each lateral. In some example embodiments, the fluid (e.g., oil) flow from a lateral is controlled by placing an ICV above the window (e.g., opening or aperture) where the lateral connects to the main bore or another lateral.

For example, as shown in FIG. 1, the lateral 104 is the main bore. Natural gas may enter the lateral 104 through perforation 118 of the lateral 104. Perforations 118 are sharp shots that allow access/communication between the formation and the wellbore. ICV 110, placed above the perforation 118, controls the flow of gas from the gas source 120 through the perforation 118 in the case of a cased hole completion, or through the lateral 104 in the case of an open hole completion (e.g., a screen-less completion) to the surface. ICV 112 is placed within the lateral 104, above the window through which the oil flows from the lateral 106 to the lateral 104. The ICV 112 controls the oil flow from the lateral 106 through the lateral 104 to the surface. Similarly, ICV 114 is placed within the lateral 104, above the window through which the oil flows from the lateral 108 to the lateral 104. The ICV 114 controls the oil flow from the lateral 108 through the lateral 104 to the surface.

As shown in FIG. 1, each of the ICVs 110, 112, and 114 has an isolation packer (e.g., 116, 130, and 132) placed above the respective ICV to eliminate behind-pipe flow and to cause the gas or the mixture of oil and gas to flow through the respective ICV.

For example, as gas flows through the lateral 104, an isolation packer placed above the ICV 110 precludes the uphole flow of gas around the ICV 110. Instead, the gas is forced to flow solely through the ICV 110 when the ICV 110 is open. Further, as the gas flows through the open ICV 110, it mixes with the oil received from the oil reservoir 122 via the lateral 106, in zone 124 of the lateral 104. A second isolation packer placed above the ICV 112 precludes the uphole flow of the oil and gas mixture around the ICV 112. Instead, the oil and gas mixture is forced to flow solely through the ICV 112 when the ICV 112 is open. Similarly, as the oil and gas flows through the open ICV 112, it mixes with the oil received from the oil reservoir 122 via the lateral 108, in zone 126 of the lateral 104. A third isolation packer placed above the ICV 114 precludes the uphole flow of the oil and gas mixture around the ICV 114. Instead, the oil and gas mixture is forced to flow solely through the ICV 114 when the ICV 114 is open.

The ICVs shown in FIG. 1 may be actuated (e.g., partially opened, fully opened, or closed) automatically based on a fluid pressure gradient value determined using pressure data captured by a plurality of downwhole sensors placed upstream of the ICVs within the multilateral well 102. The plurality (e.g., two) of downwhole sensors are placed in area 128 of the well 102 to measure the pressure of the fluid passing through the tubing of the multilateral well 102. In some example embodiments, the plurality of sensors are placed at least 100 ft. vertically apart from each other, above a top mixing point during flowing condition. The top mixing point is an area above the top-most ICV (e.g., the ICV 114) where the mixing of oil, water and gas occurs within the well 102.

In some example embodiments, the plurality of downwhole pressure sensors, the ICVs 110, 112, and 114, and an analysis module are included in an in-situ gas lifting system for in-situ gas lifting of fluid in the multilateral well 102. The pressure data may be communicated from the downwhole pressure sensors to a surface panel through an electric cable. The surface panel may transmit the pressure data to the analysis module. The analysis module determines whether, based on the pressure data, one or more of the ICVs 110, 112, and 114 should be opened or closed to facilitate or control the fluid flow to the surface, and transmits an instruction to the surface panel to actuate the one or more of the ICVs 110, 112, and 114.

In some instances, the surface panel opens or closes an ICV through an electric signal transmitted via an electric wire connecting the surface panel and the ICV, in response to the instruction transmitted by the analysis module to the surface panel. In some instances, the surface panel opens or closes the ICV through the use of hydraulic power (e.g., a hydraulic wire or cable transports the hydraulic fluid to the ICV to actuate it) in response to the instruction transmitted by the analysis module to the surface panel. The in-situ gas lifting system may include a computer system that is similar to the computer systems 900 and 914 described with regard to FIGS. 9A and 9B, respectively, and the accompanying descriptions.

FIGS. 2A, 2B, 2C, and 2D are diagrams that illustrate inflow control valves used in an in-situ gas lifting system, according to one or more example embodiments. As stated above with respect to FIG. 1, in some example embodiments, each lateral of the multilateral well is equipped with one or more ICVs which can be partially opened, fully opened, or closed for facilitating and controlling flow from each lateral. Gas can flow from a rich gas zone via a lateral and through an opened ICV to another lateral where natural lifting of fluid received from an oil reservoir occurs.

Figure 2C:
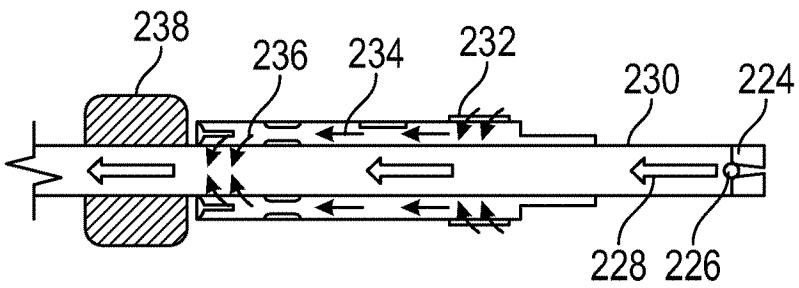
FIGS. 2A, 2B, 2C, and 2D are diagrams that illustrates inflow control valves used in an in-situ gas lifting system, according to one or more example embodiments.
Figure 2D:
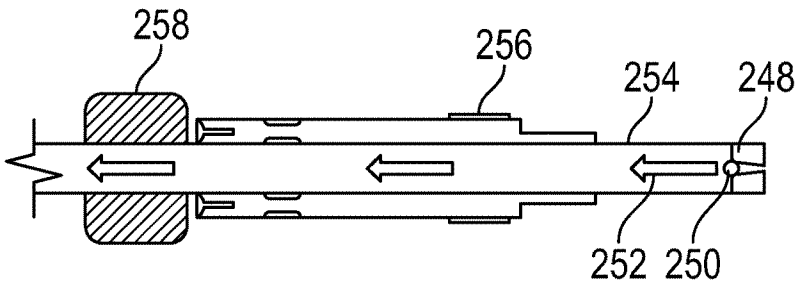
Figure 2A:
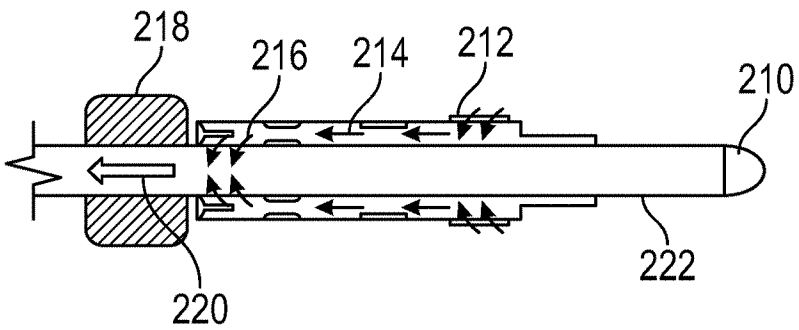
Figure 2B:
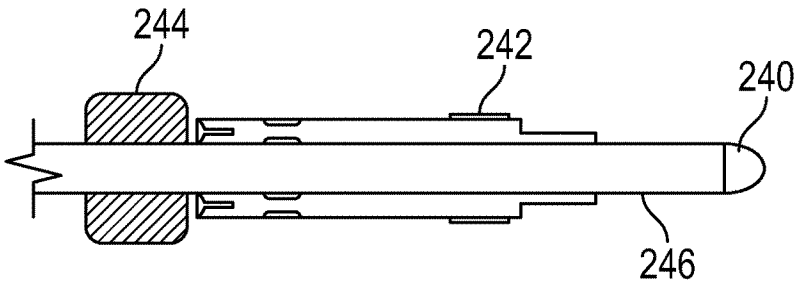

Two example types of ICVs that may be used in the in-situ gas lifting system are illustrated in FIGS. 2A and 2B, and FIGS. 2C and 2D, respectively. FIG. 2A depicts a close-ended ICV in an open position. FIG. 2B depicts the close-ended ICV in a closed position.

As shown in FIG. 2A, the close-ended ICV is equipped with a bull-nose 210 which precludes the gas from the gas source to enter the close-ended ICV through its end. The close-ended ICV may be used as part of an ICV completion system that includes an isolation packer 218. The close-ended ICV completion system may be used in a lateral that crosses a gas zone. When the close-ended ICV is in an open position, one or more ICV ports 212 are open to allow gas to flow into the close-ended ICV. The gas enters the close-ended ICV through the one or more open ICV ports 212, and flows toward a mixing point of the oil well where the gas is mixed with the oil received from another lateral. As shown in FIG. 2A, the gas 214 flows through the open close-ended ICV, and enters tube 222 in area 216. Arrow 220 represents the gas flowing through the tube 222.

As shown in FIG. 2B, the close-ended ICV is in a closed position. When the close-ended ICV is in a closed position, one or more ports 242 of the close-ended ICV are closed. No gas enters the close-ended ICV through its end or through the one or more closed ports 242. The isolation packer 244 prevents behind-pipe flow of the gas. As a result, no gas flows upstream through the close-ended ICV completion system when the close-ended ICV is in the closed position.

FIG. 2C depicts a one-way ICV in an open position. FIG. 2D depicts the one-way ICV in a closed position. The one-way ICV is equipped with a flapper or a ball-seat 224. The one-way ICV may be used as part of an ICV completion system that includes an isolation packer 238. The one-way ICV completion system may be used in a lateral that crosses an oil reservoir. The one-way ICV completion system allows oil flow in one direction, as shown by arrow 228 in FIG. 2C and arrow 252 in FIG. 2D. The ball 226 in the ball-seat 224 precludes the oil from exiting the one-way ICV through the ball-seat 224 and, as a result, prevents cross-flow between the laterals in the oil reservoir.

When the one-way ICV is in an open position, one or more ICV ports 232 are open to allow additional fluid 234 to flow into the one-way ICV. The additional fluid 234 enters the one-way ICV through the one or more open ICV ports 232, and flows toward a mixing point of the oil well where the fluid is mixed with the gas received from another lateral. As shown in FIG. 2C, the additional fluid 234 flows through the open one-way ICV, and enters tube 230 in area 236 where it mixes with the fluid that enters the one-way ICV through the ball-seat 224.

As shown in FIG. 2D, the one-way ICV is in a closed position. When the one-way ICV is in a closed position, one or more ports 242 of the one-way ICV are closed. No oil enters the one-way ICV through the one or more closed ports 256. Fluid from the oil reservoir enters the closed one-way ICV solely through the ball-seat 248. Arrow 252 represents the oil that enters the closed one-way ICV through the ball-seat 248 and flows upstream through tube 254. The ball 250 in the ball-seat 248 precludes the fluid 252 from exiting the closed one-way ICV through the ball-seat 248 and, as a result, prevents cross-flow between the laterals in the oil reservoir. The isolation packer 258 prevents behind-pipe flow of the fluid. As a result, the fluid 252 will flow upstream solely through the one-way ICV completion system.

In some example embodiments, one-way ICVs (e.g., flapper ICVs and ball-seat ICVs) are utilized in both the laterals that cross the gas zone and the laterals that cross the oil reservoir. However, because the flapper ICVs and the ball-seat ICVs may be more prone to failure when subjected to high pressure, close-ended ICVs are often used in laterals placed across the gas zone to withstand the high pressure of the gas in the gas zone.

Figure 3:
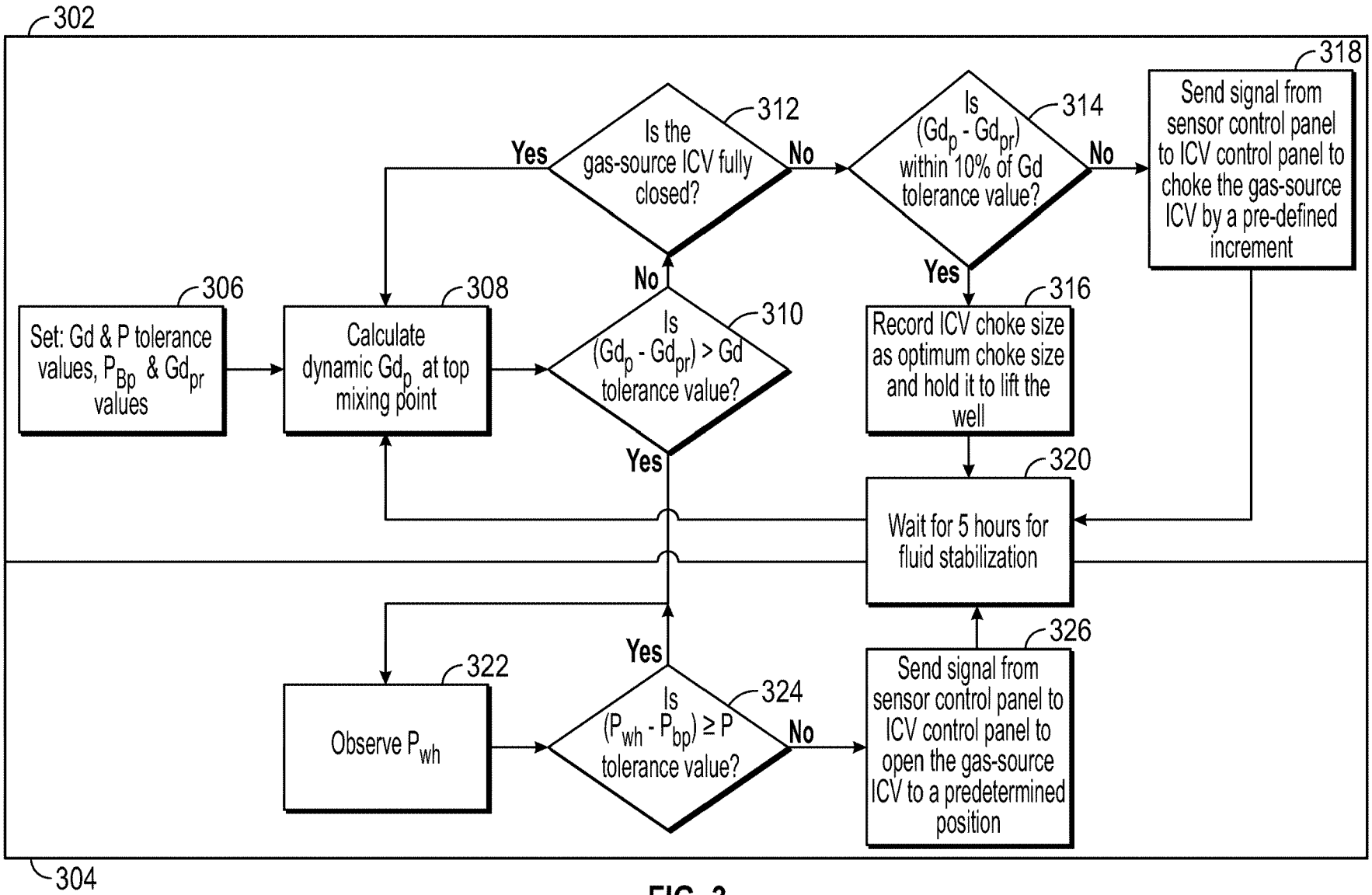
FIG. 3 is a flow diagram that illustrates an algorithm for automatic in-situ gas lifting using inflow control valves, according to one or more example embodiments.

FIG. 3 is a flow diagram that illustrates an algorithm for enabling automatic in-situ gas lifting using inflow control valves, according to one or more example embodiments. The in-situ gas lifting system may cause automatic in-situ gas lift of fluid in one lateral of a multilateral well based on using an ICV that controls the flow of a gas from a natural source of gas through another lateral of the multilateral well. The algorithm may be used, in some example embodiments, by the in-situ gas lifting system to manage the timely introduction of gas or light fluid, when needed, before fluid ceases to flow from the multilateral well. The use of the algorithm preserves the momentum of the flow and reduces downtime in the operation of the multilateral well.

In some example embodiments, an algorithm based on downhole sensors pressure data is used to perform the automatic in-situ gas lift of the fluid. Two sensors are placed at least 100 ft. apart vertically, above the top-most ICV in the lateral (e.g., the main bore) where the mixing of oil, water, and gas occur. The distance of at least 100 ft. allows for an accurate determination of a fluid pressure gradient value. The fluid pressure gradient value is a number that describes the rate of pressure change with respect to elevation (or vertical distance) at a single location due to the presence of a single or different fluids.

The algorithm utilizes the annulus (e.g., the space between the inner casing and outer tubing) pressure as an estimate of the dynamic reservoir pressure at each lateral. This value can be used to calculate the pressure at the wellhead based on the fluid gradient as shown below:

$$Gd_p = \frac{P_2 - P_1}{D} \quad (1)$$

$$P_{wf} = P_{fwh} + Gd_p \cdot D + \Delta P_f \quad (2)$$

where $Gd_p$ is calculated above the top mixing point during flowing conditions, where $P_1$ and $P_2$ are tubing pressure values from two sensors with at least 100 ft. vertical spacing in-between, and where D is the distance between the two sensors. The value $\Delta P_f$ is the pressure loss in the tubing due to friction and can be calculated using flow correlations for multi-phase flow, such as Beggs and Brill, Hagedorn and Brown, or Petalas and Aziz. The algorithm is designed to trigger automatic valve closure or opening depending on a calculated pressure gradient tolerance value. The calculation process is iterative.

Wells tend to cease flowing when the flowing wellhead pressure is not high enough to overcome backpressure. The backpressure is a surface pressure value that is determined based on the processing facility design, the distance from the facility, and the number of connected wells on the same flowline manifold. When different wells with different flowing wellhead pressures are connected on the same flowline, they tend to affect the backpressure induced on every single one of them. Typically, stronger wells with high gas oil ratios cause additional backpressure on weaker and lower gas oil ratio wells as they are all connected on the same flowline and are in hydraulic communication.

The algorithm is designed to trigger automatically and open ICV 110 to allow the gas to be mixed with the stream and increase the flowing wellhead pressure. When the well is first put on stream, a reference gradient ($Gd_{pr}$) is recorded. This reference gradient is determined based on sensor pressure values $P_1$ and $P_2$ captured with a water-free fluid column, when the wellhead pressure is the maximum wellhead pressure under natural flow at a specific surface choke setting. When the pressure gradient increases (e.g., the fluid column becomes heavier due to the introduction of water) and the flowing wellhead pressure decreases, a new gradient value ($Gd_p$) is recorded. The algorithm benchmarks the decrease in the flowing wellhead pressure and subtracts it from the backpressure in an iterative process. The ICV used to prevent or restrict flow from the gas zone is opened at an initial, pre-determined position to allow the flow of gas or light fluid, to lighten the fluid column, to reduce the pressure gradient, and to increase the flowing wellhead pressure. The calculation process is repeated again, and the gradient will be continuously updated and compared to the tolerance in order to determine whether to open or choke (e.g., close) the gas-source ICV as shown in FIG. 3. Gd is the pressure gradient. Gd tolerance is the tolerance value that is pre-set to be benchmarked with respect to the subtracted value between the $Gd_p$, the dynamic pressure gradient during the flowing condition, and the $Gd_{pr}$, reference pressure gradient. $P_{Bp}$ is the backpressure, which is a constant value. It is also known as the downstream pressure. $P_{wf}$ is the flowing wellhead pressure, also known as the upstream pressure. P tolerance is a tolerance value that is pre-set as a benchmark between the $P_{wf}$ and the $P_{Bp}$. In other words, it is a value that indicates how much offset is desired to facilitate natural flow at a desired production rate.

As illustrated in FIG. 3, in some example embodiments, the algorithm includes two parts: a pressure gradient algorithm 302 and a wellhead pressure algorithm 304. At step 306 of the pressure gradient algorithm 302, the in-situ gas lifting system sets the Gd and P tolerance values, and the $P_{Bp}$ and $Gd_{pr}$ values. Then, at step 308, the in-situ gas lifting system calculates the dynamic $Gd_p$ at the top mixing point. At step 310, the in-situ gas lifting system determines whether the difference between $Gd_p$ and $Gd_{pr}$ is greater than the Gd tolerance. If the difference between $Gd_p$ and $Gd_{pr}$ is not greater than the Gd tolerance, then the in-situ gas lifting system ensures, at step 312, that the gas-source ICV is fully closed. If the difference between $Gd_p$ and $Gd_{pr}$ is greater than the Gd tolerance, then the in-situ gas lifting system proceeds to step 322 of the wellhead pressure algorithm 304.

If, at step 312, the in-situ gas lifting system determines that the gas-source ICV is fully closed, the in-situ gas lifting system performs step 308 again. If, at step 312, the in-situ gas lifting system determines that the gas-source ICV is not fully closed, the in-situ gas lifting system proceeds to step 314. At step 314, the in-situ gas lifting system determines whether the difference between $Gd_p$ and $Gd_{pr}$ is within ten percent of the Gd tolerance.

If at step 314, the in-situ gas lifting system determines that the difference between $Gd_p$ and $Gd_{pr}$ is within ten percent of the Gd tolerance, the in-situ gas lifting system proceeds to step 316. At step 316, the in-situ gas lifting system records the ICV choke size as the optimum choke size and holds it to lift the well. If at step 314, the in-situ gas lifting system determines that the difference between $Gd_p$ and $Gd_{pr}$ is not within ten percent of the Gd tolerance, the in-situ gas lifting system proceeds to step 318. At step 318, the in-situ gas lifting system sends a signal from a sensor control panel to the ICV control panel to choke the gas-source ICV by a pre-defined value (e.g., increment).

After performing either step 316 or step 318, the in-situ gas lifting system proceeds to step 320, at which the in-situ gas lifting system waits for a certain period of time (e.g., five hours) for the fluid to stabilize. After the certain period of time, the in-situ gas lifting system performs step 308 again.

As stated above, if the in-situ gas lifting system determines, at step 310, that the difference between $Gd_p$ and $Gd_{pr}$ is greater than the Gd tolerance, then the in-situ gas lifting system proceeds to step 322 of the wellhead pressure algorithm 304. At step 322, the in-situ gas lifting system observes $P_{wh}$. At step 324, the in-situ gas lifting system determines whether the difference between $P_{wh}$ and $P_{Bp}$ is greater than or equal to the P tolerance. If the in-situ gas lifting system determines that the difference between $P_{wh}$ and $P_{Bp}$ is greater than or equal to the P tolerance, then the in-situ gas lifting system performs step 322 again. If the in-situ gas lifting system determines that the difference between $P_{wh}$ and $P_{Bp}$ is less than the P tolerance, then the in-situ gas lifting system proceeds to step 326. At step 326, the in-situ gas lifting system sends a signal from the sensor control panel to the ICV control panel to open the gas-source ICV to a predetermined position.

Figure 4:
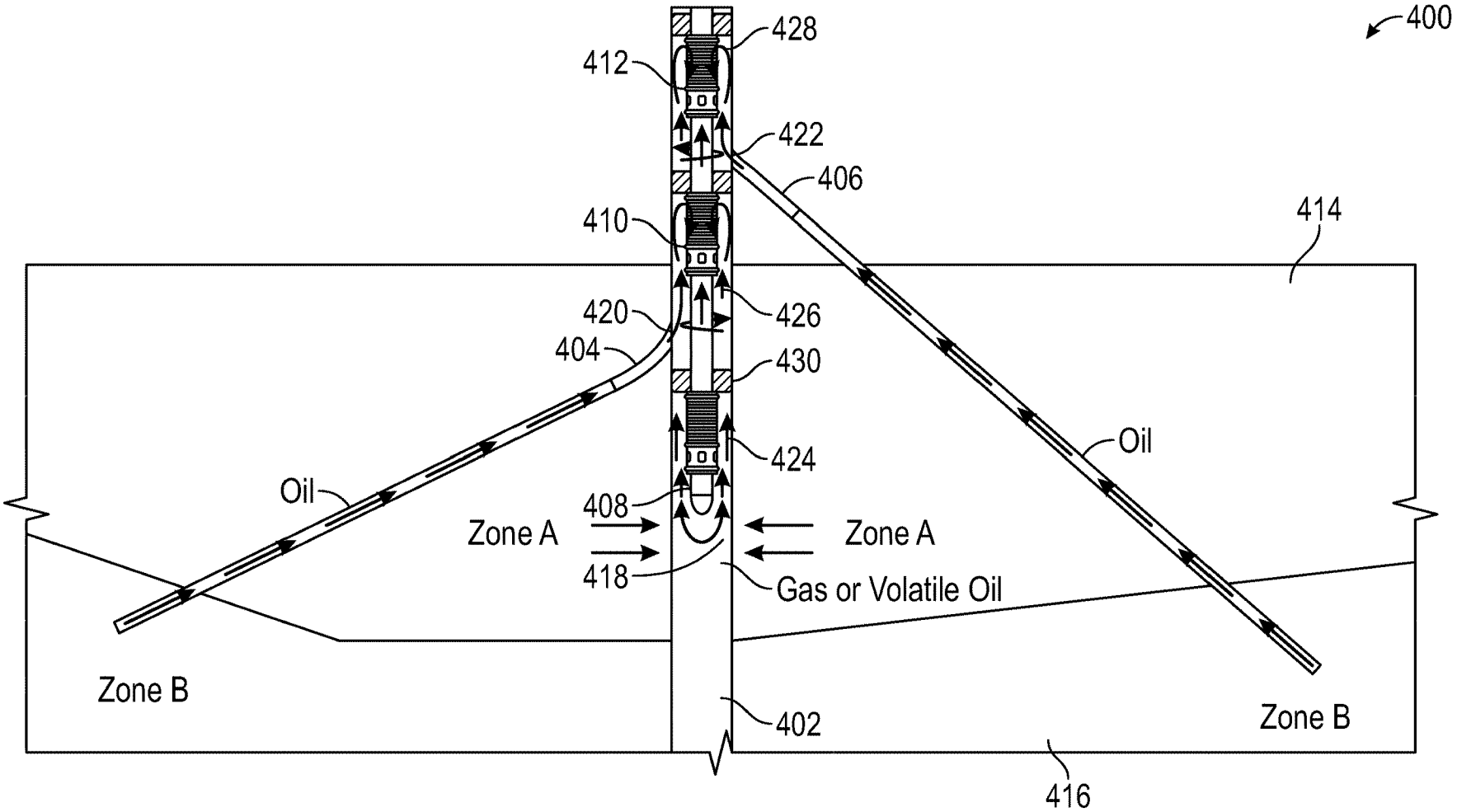
FIG. 4 is a diagram that illustrate the operation of an in-situ gas lifting system when gas lifting is not performed, according to one or more example embodiments.

FIG. 4 is a diagram 400 that illustrates the operation of an in-situ gas lifting system when gas lifting is not performed, according to one or more example embodiments. As shown in FIG. 4, lateral 402 crosses Zone A 414. Zone A 414 is a gas or volatile oil zone. A close-ended ICV 408 is located in the lateral 402 above area 418 of the lateral 402. Laterals 404 and 406 cross Zone B 416. Zone B 416 is an oil reservoir. A one-way ICV 410 is placed within the lateral 402 above window 420 that connects the lateral 404 to the lateral 402, and through which oil 426 flows from the Zone B 416 into the lateral 402 via the lateral 404. A one-way ICV 412 is placed above window 422 that connects the lateral 406 to the lateral 402, and through which oil 428 flows from the Zone B 416 into the lateral 402 via the lateral 406.

When oil (or a mix of oil and water) flows freely from the lateral 404 through the ICV 410 or from the lateral 406 through the ICV 412 to the surface, the in-situ gas lifting system does not employ in-situ gas lifting using gas (or volatile oil) from the Zone A 414 via the lateral 402. The energy of the oil reservoir in the Zone B 416 is sufficient to overcome the hydrostatic pressure exerted by the fluid column, the oil from Zone B 416 flows to the surface via the lateral 404 or the lateral 406, and there is no need to lighten the fluid column by introducing gas from the Zone A 414. The ICV 408 is kept closed. The isolation packer 430 prevents behind-pipe flow of the gas 424 that has entered the lateral 402 from the Zone A 414 via the area 418 of the lateral 402. As a result, no gas (or volatile oil) flows upstream through the ICV 408. Further details with respect to the operation of the in-situ gas lifting system are described below with respect to FIG. 8.

Figure 5:
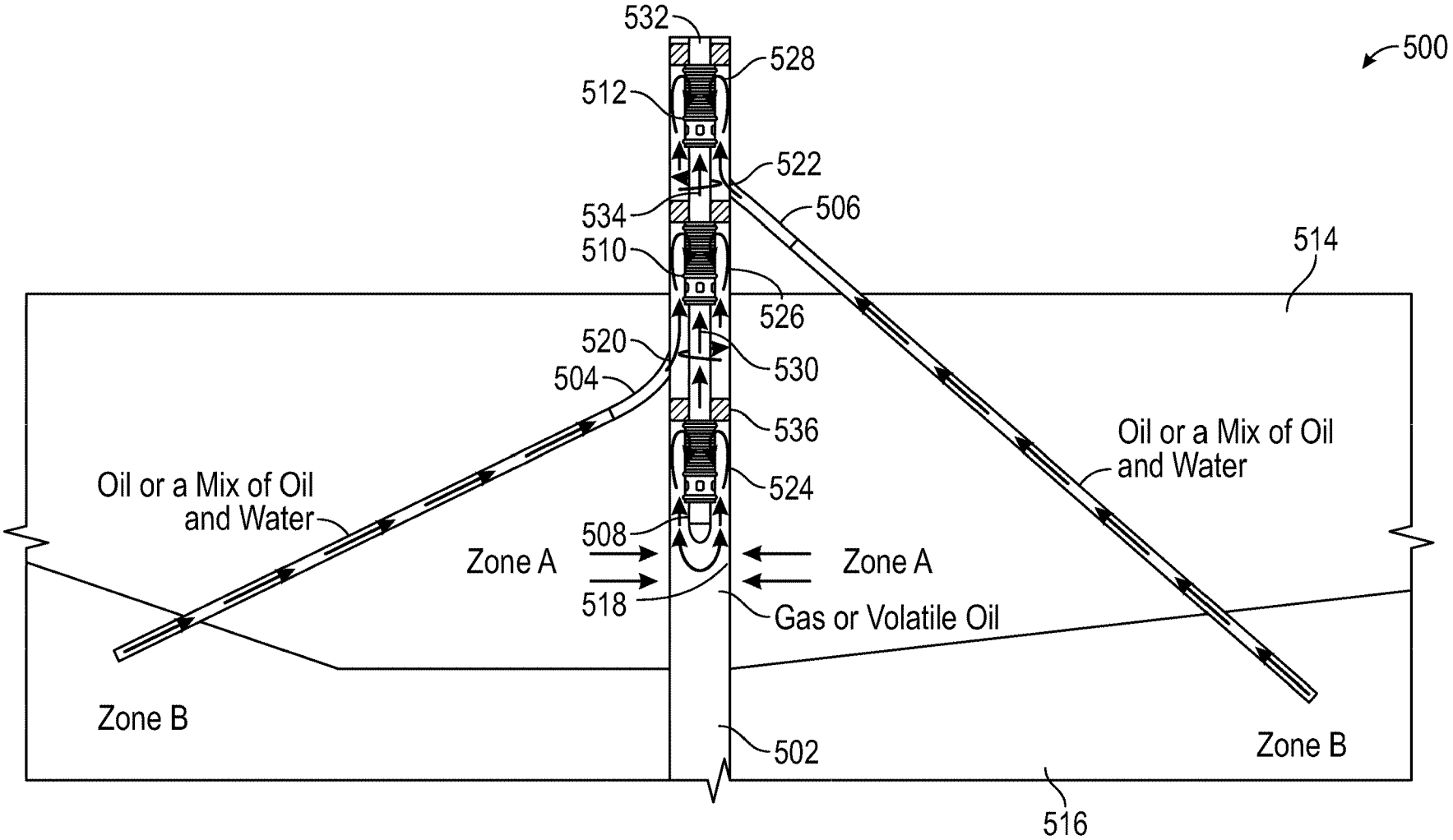
FIG. 5 is a diagram that illustrate the operation of an in-situ gas lifting system when gas lifting is performed, according to one or more example embodiments.

FIG. 5 is a diagram 500 that illustrates the operation of the in-situ gas lifting system when gas lifting is performed, according to one or more example embodiments. As shown in FIG. 5, lateral 502 crosses Zone A 514. Zone A 514 is a gas or volatile oil zone. A close-ended ICV 508 is located in the lateral 502 above area 518 of the lateral 502. Laterals 504 and 506 cross Zone B 516. Zone B 516 is an oil reservoir that is or has become under-saturated. A one-way ICV 510 is placed within the lateral 502 above window 520 that connects the lateral 504 to the lateral 502, and through which oil 526 flows from the Zone B 516 into the lateral 502 via the lateral 504. A one-way ICV 512 is placed above window 522 that connects the lateral 506 to the lateral 502, and through which oil 528 flows from the Zone B 516 into the lateral 502 via the lateral 506.

When one or both of the laterals 504 and 506 begin cutting water, the multilateral well ceases to flow if the reservoir pressure is not sufficient to lift the fluid to the surface ($P_{r<}P_{Hydrostatic}$). In this case, gas lifting using gas from the Zone A514 is performed. The ICV 508 included in the lateral 502 is opened to supply the fluid column with gas 524 (or volatile oil) to lighten the heavy fluid column and to reduce the hydrostatic pressure ($P_{r>}P_{Hydrostatic}$) in order to facilitate flow to the surface. The gas 524 enters the lateral 502 in area 518 of the lateral 502. An isolation packer 536 placed above the ICV 508 eliminates behind-pipe flow of the gas 524 and ensures that the open ICV 508 is the only opening for the gas 524 to flow. Arrow 530 represents the gas flowing uphole in the tube 532 between the ICV 508 and the ICV 510.

If the one-way ICV 510 placed above the window 520 is open, the oil 526 that flows from the lateral 504 enters the ICV 510 through one or more open ICV ports of the ICV 510 and mixes with the gas 530. The gas 530 lightens the heavy fluid column and facilitates the flow to the surface, as shown by arrow 534. If the one-way ICV 510 is closed, the one or more ICV ports of the ICV 510 are closed and do not allow inflow of oil into the tube 532 via the lateral 504. However, the gas 530 may continue to flow through the one-way ICV 510 (as shown in FIG. 2D).

Further, if the one-way ICV 512 placed above the window 522 is open, the oil 528 that flows from the lateral 506 enters the ICV 512 through one or more open ICV ports of the ICV 512 and mixes with the gas 530 (or a mix of oil and gas 534 that is created when the gas 524 mixes with the oil 526). The gas 530 lightens the heavy fluid column and facilitates the flow to the surface. If the one-way ICV 512 is closed, the one or more ICV ports of the ICV 512 are closed and do not allow inflow of oil into the tube 532 via the lateral 506. However, the gas 530 or the mix of oil and gas 534 may continue to flow through the one-way ICV 512 (as shown in FIG. 2D).

Figure 6:
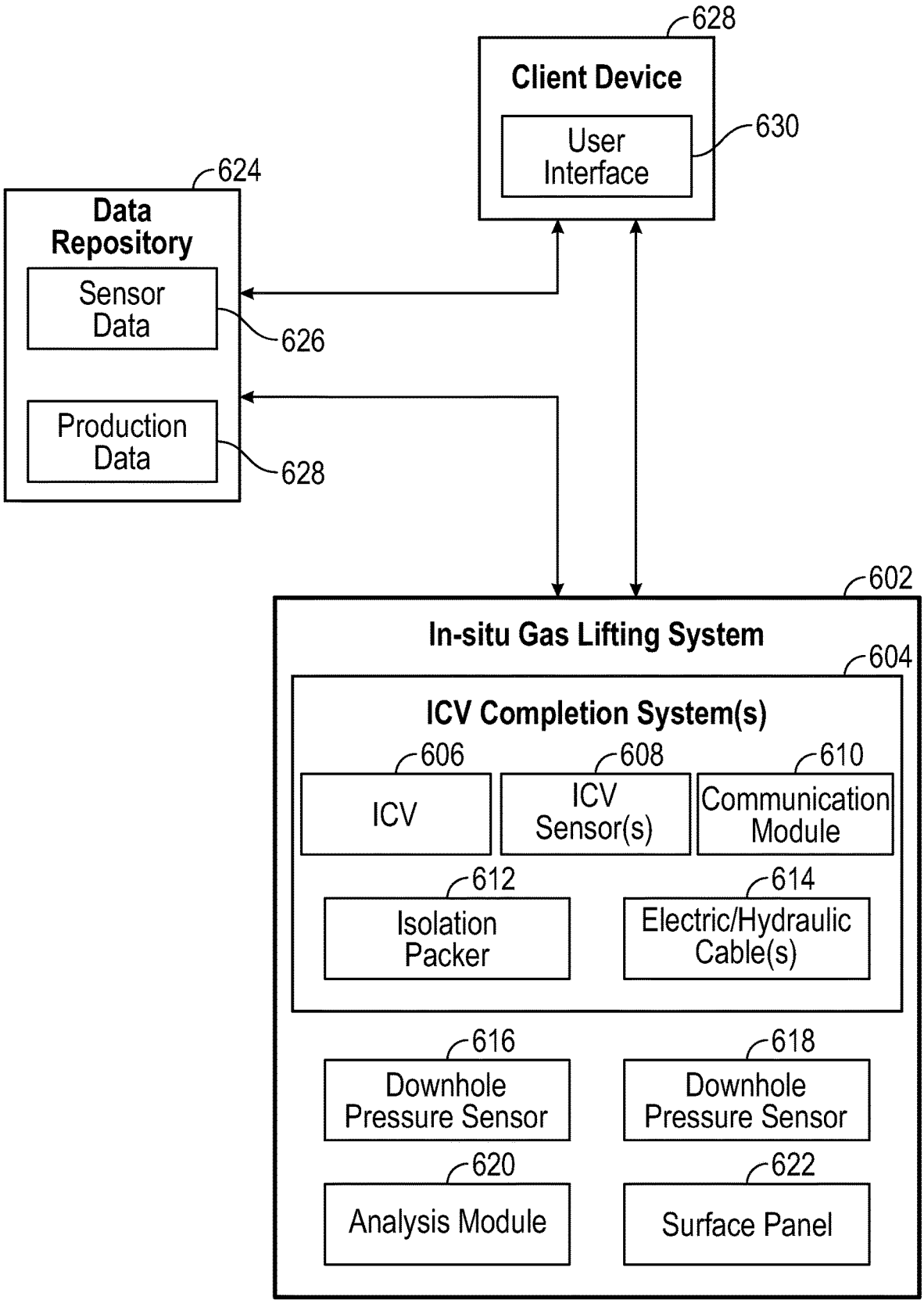
FIG. 6 is a block diagram that illustrates the in-situ gas lifting system, according to one or more example embodiments.

FIG. 6 is a block diagram that illustrates an in-situ gas lifting system, according to one or more example embodiments. In FIG. 6, the in-situ gas lifting system 602 is operatively connected to a client device 628 and a data repository 624. The in-situ gas lifting system 602 is shown as including one or more ICV completion systems 604. The ICV completion system 604 includes downhole pressure sensor (616, 618), an analysis module 620, and a surface panel 622. In one or more embodiments, an ICV completion system 604 may be placed in a first lateral of a multilateral well to utilize the flow of a downhole natural gas from the first lateral to reduce the density of a fluid flowing from a second lateral and to cause the natural lift of the fluid to the surface. The downhole pressure sensors 616, 618 are located at least 100 ft. vertically apart within a main bore (or a lateral), above the top-most ICV, and are configured to periodically measure (e.g., capture) fluid pressure data. The fluid pressure data measured by the sensors 616, 618 is stored as sensor data 626 in a data repository 624. The data repository may be any type of storage, such as non-persistent storage (e.g., random access memory (RAM), cache memory, or flash memory), one or more persistent storage (e.g., a hard disk), or any other suitable type of memory capable of storing data within data structures such as arrays, lists, tables, etc. The analysis module 620 (e.g., a processor) dynamically determines a fluid pressure gradient value associated with the multilateral well based on the periodically captured pressure data, and determines whether the ICVs included in the one or more ICV completion systems 604 should be opened or closed bases on the fluid pressure gradient value.

A shown in FIG. 6, the ICV completion system 604 includes an ICV 606, ICV sensor(s) 608, a communication module 610, an isolation packer 612, and an electric wire or hydraulic cable 614. The components of the in-situ gas lifting system 602 are operatively connected and are configured to communicate with each other (e.g., via a wire, a cable, a bus, shared memory, a switch, wirelessly, etc.). The ICV sensor(s) 608 may include a pressure sensor or a temperature sensor. The communication module 610 transmits and receives communications (e.g., signals) to and from the analysis module 620 via a surface panel 622.

In some example embodiments, the downhole pressure sensors 616, 618 communicate the measured pressure data to the surface panel 622 through an electric cable 614. The surface panel 622 may transmit the pressure data to the analysis module 620 through an electric cable 614 or wirelessly. The analysis module 620 determines whether, based on the pressure data, one or more of the ICVs 606 should be opened or closed to facilitate or control the fluid flow to the surface, and transmits an instruction to the surface panel 622 to actuate the one or more of the ICVs 606.

In some instances, the surface panel opens or closes an ICV through an electric signal transmitted via an electric wire 614 connecting the surface panel 622 and the ICV 606, in response to the instruction transmitted by the analysis module 620 to the surface panel 622. In some instances, the surface panel 622 opens or closes the ICV 606 through the use of hydraulic power (e.g., a hydraulic cable transports the hydraulic fluid to the ICV to actuate it) in response to the instruction transmitted by the analysis module 620 to the surface panel 622.

The analysis module 620 may be implemented using hardware (e.g., one or more processors of a machine) or a combination of hardware and software. For example, the analysis module 620 may configure a processor to perform the operations described herein for the analysis module 620. According to another example, the analysis module 620 is a hardware processor that performs the operations described herein for the analysis module 620. In some example embodiments, the analysis module 620 may be distributed across multiple machines or devices.

The in-situ gas lifting system 604 is also configured to communicate with a client device 628 that includes the user interface 630. In some example embodiments, a user of the client device 628 accesses the in-situ gas lifting system 604 via the user interface 630. The user may, for example, make configuration changes to the one or more modules included in the in-situ gas lifting system 604. The client device 628 is also configured to communicate with the data repository 624 to access and store data.

Figure 7:
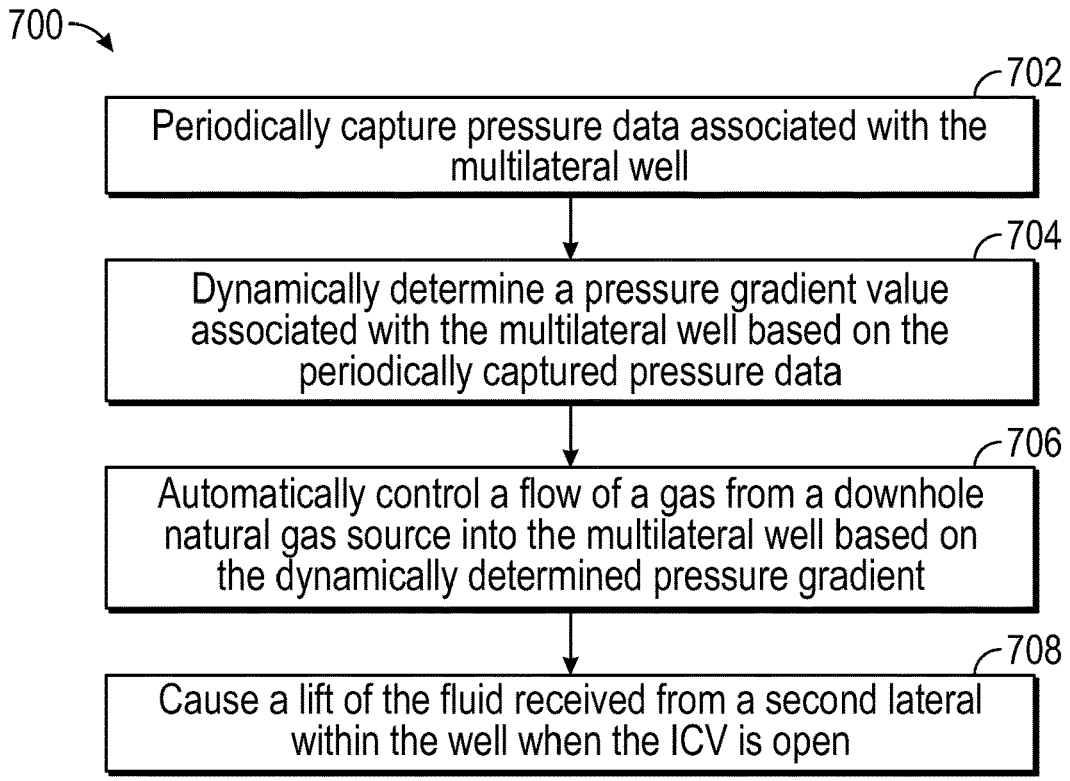
FIGS. 7 and 8 are flowcharts illustrating operations of the in-situ gas lifting system in performing a method for automatic in-situ gas lifting of a fluid in a multilateral well, according to one or more example embodiments.
Figure 8:
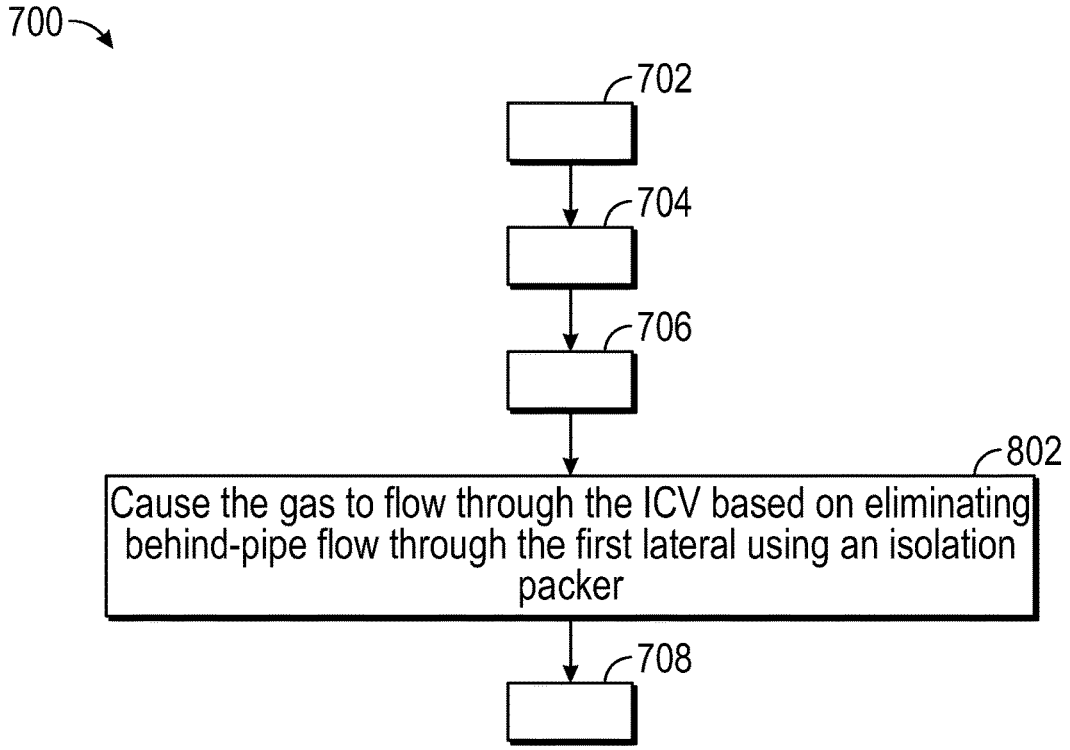

FIGS. 7 and 8 are flowcharts illustrating operations of the in-situ gas lifting system in performing a method 700 for in-situ gas lifting of a fluid in a multilateral well, according to one or more example embodiments. Operations of the method 700 may be performed using the components described above with respect to FIG. 6. One or more blocks in FIGS. 7 and 8 may be performed by a computing system such as that shown and described below in FIGS. 9A and 9B. While the various blocks in FIGS. 7 and 8 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

At Step 702, a plurality of downhole sensors (e.g., the downhole pressure sensors 616 and 618) periodically capture pressure data associated with the multilateral well. In some example embodiments, the plurality of downhole sensors include two sensors located at least 100 feet apart vertically, above a top mixing point during flowing condition.

At Step 704, a processor (e.g., the analysis module 620 of FIG. 6) dynamically determines a pressure gradient value associated with the multilateral well based on the periodically captured pressure data. The pressure gradient value may be dynamically determined based on a difference between a first pressure value, determined by a first sensor of the two sensors located at least 100 feet apart vertically above the top mixing point during flowing condition, and a second pressure value, determined by a second sensor of the two sensors.

At Step 706, a first ICV (e.g., the ICV 606) that is placed within a first lateral automatically controls a flow of a gas from a downhole natural gas source into the multilateral well based on the dynamically determined pressure gradient. In some example embodiments, the ICV includes a close-ended ICV equipped with a bullnose. The close-ended ICV prevents uncontrolled gas production through the first lateral.

In some example embodiments, a second ICV disposed within the first lateral, above a window that connects the second lateral to the first lateral, controls the flow from the second lateral. The plurality of downhole sensors are located upstream of the first ICV and the second ICV.

In various example embodiments, the first ICV is a close-ended ICV. In some instances, a second ICV, which is a one-way ICV, is placed within the first lateral, above a window that connects the second lateral to the first lateral, to control the flow from the second lateral. In some instances, a second ICV, which is a one-way ICV, is placed within the second lateral to isolate the second lateral. In certain instances, the one-way ICV is equipped with a flapper. In certain instances, the one-way ICV is equipped with a ball-seat.

In certain example embodiments, the first ICV is a one-way ICV. In some instances, a second ICV is another one-way ICV that is placed within the second lateral to isolate the second lateral. In some instances, a second ICV, which is another one-way ICV, is placed within the first lateral, above a window that connects the second lateral to the first lateral, to control the flow from the second lateral.

At Step 708, the ICV causes a lift of the fluid received from a second lateral within the well when the ICV is open. In some example embodiments, the processor generates an instruction for actuating the ICV based on the dynamically determined pressure gradient. The processor transmits the instruction for actuating the ICV to a surface panel. The surface panel receives the instruction for actuating the ICV, and actuates (opens or chokes) the ICV based on the instruction. The ICV causes the lift of the fluid received from the second lateral within the well when the ICV is open as a result of the surface panel causing an opening of the ICV based on the instruction. Further details with respect to the operations of the method 700 are described below with respect to FIG. 8.

As shown in FIG. 8, the method 700 may include Step 802, according to some example embodiments. Step 802 may be performed after operation 706, in which the ICV that is placed within the first lateral automatically controls the flow of the gas from the downhole natural gas source into the multilateral well based on the dynamically determined pressure gradient. At operation 802, an isolation packer (e.g., the isolation packer 612) that is placed within the first lateral and above the ICV causes the gas to flow through the ICV based on eliminating (e.g., precluding) behind-pipe flow through the first lateral. The isolation packer may be open-hole to allow its placement above the ICV. Open-hole packers eliminate behind-pipe flow and ensure that the ICVs are the only opening for fluid flow.

In some example embodiments, the ICV is included in an ICV completion system, and an isolation packer is placed within the first lateral and above the ICV completion system. In various example embodiments, the isolation packer is included in the ICV completion system. In certain example embodiments, the ICV completion system further includes at least one of a pressure sensor to measure a pressure of the gas within the ICV completion system, a temperature sensor to measure a temperature of the gas within the ICV completion system, or a communication module to receive communications from the processor and to transmit communications to the processor.

Figure 9A:
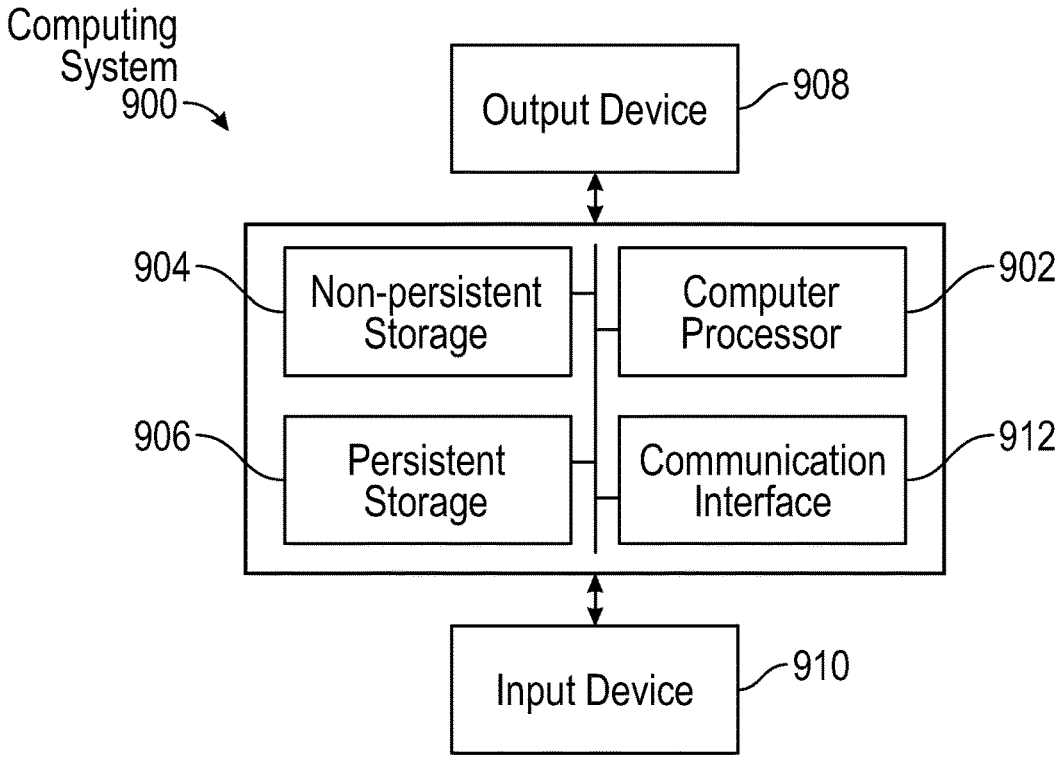
FIGS. 9A and 9B illustrate a computing system, according to one or more example embodiments.

Example embodiments may be implemented on a computing system. Any combination of mobile, desktop, server, router, switch, embedded device, or other types of hardware may be used. For example, as shown in FIG. 9A, the computing system 900 may include one or more computer processors 902, non-persistent storage 904 (e.g., volatile memory, such as random access memory (RAM) or cache memory), persistent storage 906 (e.g., a hard disk, an optical drive such as a compact disk (CD) drive or digital versatile disk (DVD) drive, or a flash memory), a communication interface 912 (e.g., Bluetooth interface, infrared interface, network interface, or optical interface), and numerous other elements and functionalities.

The computer processor(s) 902 may be an integrated circuit for processing instructions. For example, the computer processor(s) 902 may be one or more cores or micro-cores of a processor. The computing system 900 may also include one or more input devices 910, such as a touchscreen, keyboard, mouse, microphone, touchpad, or electronic pen.

The communication interface 912 may include an integrated circuit for connecting the computing system 900 to a network (not shown) (e.g., a local area network (LAN), a wide area network (WAN), such as the Internet, mobile network, or any other type of network) or to another device, such as another computing device.

Further, the computing system 900 may include one or more output devices 908, such as a screen (e.g., a liquid crystal display (LCD), a plasma display, touchscreen, cathode ray tube (CRT) monitor, or projector), a printer, external storage, or any other output device. One or more of the output devices may be the same or different from the input device(s). The input and output device(s) may be locally or remotely connected to the computer processor(s) 902, non-persistent storage 904, and persistent storage 906. Many different types of computing systems exist, and the aforementioned input and output device(s) may take other forms.

Software instructions in the form of computer readable program code to perform embodiments of the disclosure may be stored, in whole or in part, temporarily or permanently, on a non-transitory computer readable medium such as a CD, DVD, storage device, a diskette, a tape, flash memory, physical memory, or any other computer readable storage medium. Specifically, the software instructions may correspond to computer readable program code that when executed by a processor(s) is configured to perform one or more embodiments of the disclosure.

Figure 9B:
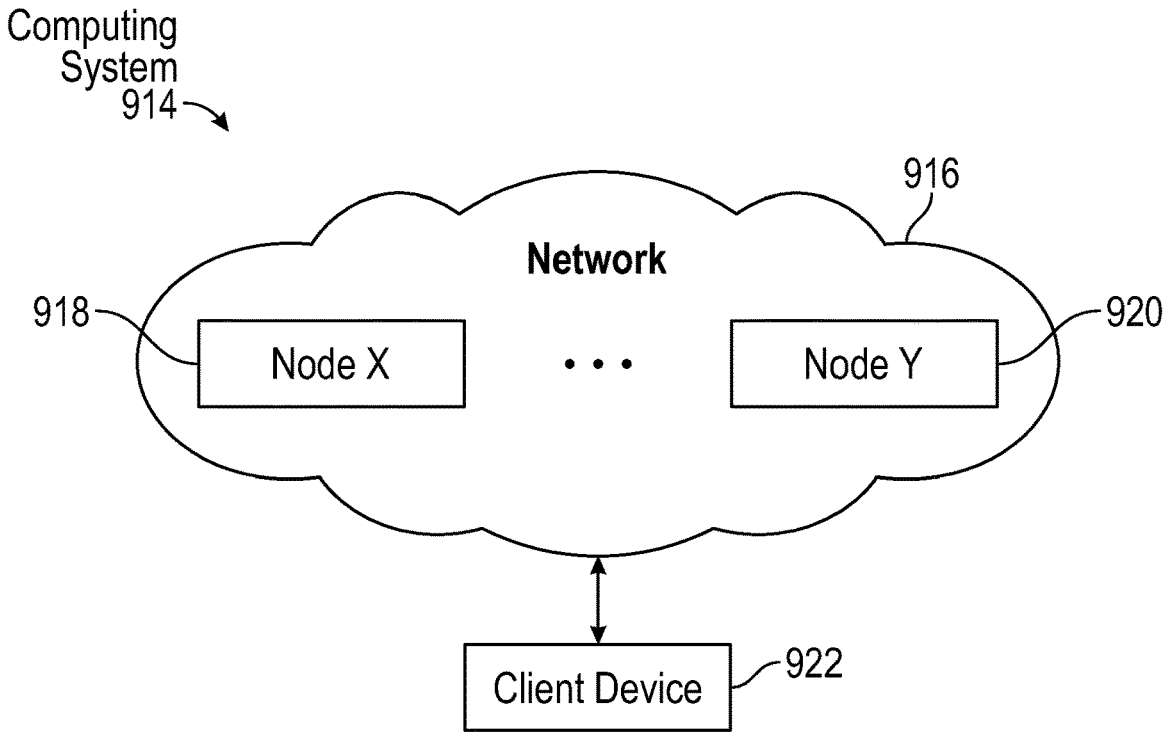

The computing system 900 in FIG. 9A may be connected to or be a part of a network. For example, as shown in FIG. 9B, the network 916 may include multiple nodes (e.g., node X 918 or node Y 920). Each node may correspond to a computing system, such as the computing system shown in FIG. 9B, or a group of nodes combined may correspond to the computing system shown in FIG. 9B. By way of an example, embodiments of the disclosure may be implemented on a node of a distributed system that is connected to other nodes. By way of another example, embodiments of the disclosure may be implemented on a distributed computing system having multiple nodes, where each portion of the disclosure may be located on a different node within the distributed computing system. Further, one or more elements of the aforementioned computing system 914 may be located at a remote location and connected to the other elements over a network.

Although not shown in FIG. 9B, the node may correspond to a blade in a server chassis that is connected to other nodes via a backplane. By way of another example, the node may correspond to a server in a data center. By way of another example, the node may correspond to a computer processor or micro-core of a computer processor with shared memory or resources.

The nodes (e.g., node X 918 or node Y 920) in the network 916 may be configured to provide services for a client device 922. For example, the nodes may be part of a cloud computing system. The nodes may include functionality to receive requests from the client device 922 and transmit responses to the client device 922. The client device 922 may be a computing system, such as the computing system shown in FIG. 9B. Further, the client device 922 may include or perform all or a portion of one or more embodiments of the disclosure.

The computing system or group of computing systems described in FIGS. 9A and 9B may include functionality to perform a variety of operations disclosed herein. For example, the computing system(s) may perform communication between processes on the same or different systems. A variety of mechanisms, employing some form of active or passive communication, may facilitate the exchange of data between processes on the same device. Examples representative of these inter-process communications include, but are not limited to, the implementation of a file, a signal, a socket, a message queue, a pipeline, a semaphore, shared memory, message passing, and a memory-mapped file. Further details pertaining to a couple of these non-limiting examples are provided in subsequent paragraphs.

Based on the client-server networking model, sockets may serve as interfaces or communication channel endpoints enabling bidirectional data transfer between processes on the same device. Foremost, following the client-server networking model, a server process (e.g., a process that provides data) may create a first socket object. Next, the server process binds the first socket object, thereby associating the first socket object with a unique name or address. After creating and binding the first socket object, the server process then waits and listens for incoming connection requests from one or more client processes (e.g., processes that seek data). At this point, when a client process wishes to obtain data from a server process, the client process starts by creating a second socket object. The client process then proceeds to generate a connection request that includes at least the second socket object and the unique name or address associated with the first socket object. The client process then transmits the connection request to the server process. Depending on availability, the server process may accept the connection request, establishing a communication channel with the client process, or the server process, busy in handling other operations, may queue the connection request in a buffer until the server process is ready. An established connection informs the client process that communications may commence. In response, the client process may generate a data request specifying the data that the client process wishes to obtain. The data request is subsequently transmitted to the server process. Upon receiving the data request, the server process analyzes the request and gathers the requested data. Finally, the server process then generates a reply including at least the requested data and transmits the reply to the client process. The data may be transferred, more commonly, as datagrams or a stream of characters (e.g., bytes).

Rather than or in addition to sharing data between processes, the computing system performing one or more embodiments of the disclosure may include functionality to receive data from a user. For example, in one or more embodiments, a user may submit data via a graphical user interface (GUI) on the user device. Data may be submitted via the graphical user interface by a user selecting one or more graphical user interface widgets or inserting text and other data into graphical user interface widgets using a touchpad, a keyboard, a mouse, or any other input device. In response to selecting a particular item, information regarding the particular item may be obtained from persistent or non-persistent storage by the computer processor. Upon selection of the item by the user, the contents of the obtained data regarding the particular item may be displayed on the user device in response to the selection by the user.

By way of another example, a request to obtain data regarding the particular item may be sent to a server operatively connected to the user device through a network. For example, the user may select a uniform resource locator (URL) link within a web client of the user device, thereby initiating a Hypertext Transfer Protocol (HTTP) or other protocol request being sent to the network host associated with the URL. In response to the request, the server may extract the data regarding the particular selected item and send the data to the device that initiated the request. Once the user device has received the data regarding the particular item, the contents of the received data regarding the particular item may be displayed on the user device in response to the selection by the user. Further to the above example, the data received from the server after selecting the URL link may provide a web page in Hyper Text Markup Language (HTML) that may be rendered by the web client and displayed on the user device.

The computing system in FIG. 9B may implement or be connected to a data repository. For example, one type of data repository is a database. A database is a collection of information configured for ease of data retrieval, modification, re-organization, and deletion. Database management system (DBMS) is a software application that provides an interface for users to define, create, query, update, or administer databases.

The user, or software application, may submit a statement or query into the DBMS. Then the DBMS interprets the statement. The statement may be a select statement to request information, update statement, create statement, delete statement, etc. Moreover, the statement may include parameters that specify data, or data container (database, table, record, column, view, etc.), identifier(s), conditions (comparison operators), functions (e.g., join, full join, count, or average), sort (e.g., ascending or descending), or others. The DBMS may execute the statement. For example, the DBMS may access a memory buffer, a reference or index a file for read, write, deletion, or any combination thereof, for responding to the statement. The DBMS may load the data from persistent or non-persistent storage and perform computations to respond to the query. The DBMS may return the result(s) to the user or software application.

The computing system of FIG. 9B may include functionality to present raw or processed data, such as results of comparisons and other processing. For example, presenting data may be accomplished through various presenting methods. Specifically, data may be presented through a user interface provided by a computing device. The user interface may include a GUI that displays information on a display device, such as a computer monitor or a touchscreen on a handheld computer device. The GUI may include various GUI widgets that organize what data is shown as well as how data is presented to a user. Furthermore, the GUI may present data directly to the user, for example, data presented as actual data values through text, or rendered by the computing device into a visual representation of the data, such as through visualizing a data model.

For example, a GUI may first obtain a notification from a software application requesting that a particular data object be presented within the GUI. Next, the GUI may determine a data object type associated with the particular data object, for example, by obtaining data from a data attribute within the data object that identifies the data object type. Then, the GUI may determine any rules designated for displaying that data object type, for example, rules specified by a software framework for a data object class or according to any local parameters defined by the GUI for presenting that data object type. Finally, the GUI may obtain data values from the particular data object and render a visual representation of the data values within a display device according to the designated rules for that data object type.

The previous description of functions presents only a few examples of functions performed by the computing system of FIG. 9A and the nodes or client device in FIG. 9B. Other functions may be performed using one or more embodiments of the disclosure.

While the disclosure has been described with respect to a limited number of embodiments, those skilled in the art, having benefit of this disclosure, will appreciate that other embodiments can be devised which do not depart from the scope of the disclosure as disclosed. Accordingly, the scope of the disclosure should be limited only by the attached claims.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A system for automatic in-situ gas lifting of fluid in a multilateral well, the system comprising:

a plurality of downhole sensors arranged to periodically capture pressure data associated with the multilateral well;

a processor operatively connected to the downhole sensors and configured to dynamically determine a pressure gradient value associated with the multilateral well based on the periodically captured pressure data; and a first inflow control valve (ICV) operatively connected to the processor and placed within a first lateral to:

automatically control a flow of a gas from a downhole natural gas source into the multilateral well based on the dynamically determined pressure gradient, and cause a lift of the fluid received from a second lateral within the well when the first ICV is open;

wherein the processor compares the dynamically determined pressure gradient value to a reference gradient value and, if a difference between the dynamically determined pressure gradient value and the reference gradient value is not greater than a predetermined pressure gradient tolerance, determines whether the first ICV is fully closed, wherein, when the processor determines that first ICV is fully closed:

the processor determines whether the difference between the dynamically determined pressure gradient value and the reference gradient value is within ten percent of the predetermined pressure gradient tolerance, and when the difference between the dynamically determined pressure gradient value and the reference gradient value is within ten percent of the predetermined pressure gradient tolerance, the processor records a choke size of the first ICV as an optimum choke size for controlling the flow of a gas from the downhole natural gas source into the multilateral well.

2. The system of claim 1, wherein the plurality of downhole sensors includes two sensors located at least 100 feet apart vertically, above a top mixing point during flowing condition, and wherein the pressure gradient value is dynamically determined based on a difference between a first pressure value, determined by a first sensor of the two sensors, and a second pressure value, determined by a second sensor of the two sensors.

3. The system of claim 1, further comprising:

a second ICV disposed within the first lateral, above a window that connects the second lateral to the first lateral, the second ICV controlling the flow from the second lateral, and wherein the plurality of downhole sensors are located upstream of the first ICV and the second ICV.

4. The system of claim 1, wherein the first ICV includes a close-ended ICV equipped with a bullnose, the close-ended ICV preventing uncontrolled gas production through the first lateral.

5. The system of claim 1, wherein the first ICV is a close-ended ICV that isolates the downhole natural gas source, and wherein the system further comprises:

a second ICV, the second ICV being a one-way ICV that is operatively connected to the processor and is placed within the first lateral to control the flow from the second lateral.

6. The system of claim 5, wherein the one-way ICV is equipped with a flapper.

7. The system of claim 5, wherein the one-way ICV is equipped with a ball-seat.

8. The system of claim 1, wherein the first ICV is a one-way ICV, and wherein the system further comprises: a second ICV, the second ICV being another one-way ICV that is operatively connected to the processor and is placed within the first lateral to control the flow from the second lateral.

9. The system of claim 1, wherein the system further comprises:

an isolation packer that is placed within the first lateral and above the first ICV to cause the gas to flow through the first ICV based on eliminating behind-pipe flow through the first lateral.

10. The system of claim 1, wherein the first ICV is included in an ICV completion system, and wherein the system further comprises an isolation packer that is placed within the first lateral and above the ICV completion system, the placing of the isolation packer eliminating behind pipe flow and causing the gas to flow through the ICV.

11. The system of claim 10, wherein the ICV completion system further includes at least one of: a pressure sensor that is operatively connected to the processor and is configured to measure a pressure of the gas within the ICV completion system, a temperature sensor that is operatively connected to the processor and is configured to measure a temperature of the gas within the ICV completion system, and a communication module that is operatively connected to the processor and is configured to receive communications from the processor and transmit communications to the processor.

12. The system of claim 1, wherein the processor is further configured to:

generate an instruction for actuating the first ICV based on the dynamically determined pressure gradient; and transmit the instruction for actuating the first ICV, and wherein the system further comprises a surface panel operatively connected to the processor and is configured to:

receive the instruction for actuating the first ICV; and actuate the first ICV based on the instruction.

13. The system of claim 1 wherein, if the processor determines that the difference between the dynamically determined pressure gradient value and the reference gradient value is not within ten percent of the predetermined pressure gradient tolerance, the processor sends a signal to choke the first ICV by a pre-defined increment.

14. A method for automatic in-situ gas lifting of fluid in a multilateral well, the method comprising:

periodically capturing pressure data associated with the multilateral well using a plurality of downhole sensors;

dynamically determining, using a processor, a pressure gradient value associated with the multilateral well based on the periodically captured pressure data;

automatically controlling, using a first inflow control valve (ICV) placed within a first lateral, a flow of a gas from a downhole natural gas source into the multilateral well based on the dynamically determined pressure gradient;

causing a lift of the fluid received from a second lateral within the well when the first ICV is open; and using the processor, comparing the dynamically determined pressure gradient value to a reference gradient value and, if a difference between the dynamically determined pressure gradient value and the reference gradient value is not greater than a predetermined pressure gradient tolerance, determines whether the first ICV is fully closed, wherein, if the processor determines that first ICV is fully closed:

the processor determines whether the difference between the dynamically determined pressure gradient value and the reference gradient value is within ten percent of the predetermined pressure gradient tolerance, and if the difference between the dynamically determined pressure gradient value and the reference gradient value is within ten percent of the predetermined pressure gradient tolerance, the processor records a choke size of the first ICV as an optimum choke size for controlling the flow of a gas from the downhole natural gas source into the multilateral well.

15. The method of claim 14, wherein the plurality of downhole sensors includes two sensors located at least 100 feet apart vertically, above a top mixing point during flowing condition, and wherein the pressure gradient value is dynamically determined based on a difference between a first pressure value, determined by a first sensor of the two sensors, and a second pressure value, determined by a second sensor of the two sensors.

16. The method of claim 14, further comprising:

disposing a second ICV within the first lateral, above a window that connects the second lateral to the first lateral, the second ICV controlling the flow from the second lateral, and wherein the plurality of downhole sensors are located upstream of the first ICV and the second ICV.

17. The method of claim 14, wherein the first ICV is a close-ended ICV that isolates the downhole natural gas source, and wherein the method further comprises:

placing a second ICV within the first lateral to control the flow from the second lateral, wherein the second ICV is a one-way ICV that is operatively connected to the processor.

18. The method of claim 14, wherein the first ICV is a one-way ICV, and a second ICV being another one-way ICV is operatively connected to the processor and is placed within the first lateral to control the flow from the second lateral.

19. The method of claim 14, wherein the method further comprises:

causing the gas to flow through the first ICV based on eliminating behind-pipe flow through the first lateral, the causing of the gas to flow being performed using an isolation packer that is placed within the first lateral and above the first ICV.

20. The method of claim 14, wherein the method further comprises:

generating an instruction for actuating the first ICV based on the dynamically determined pressure gradient;

transmitting the instruction for actuating the first ICV to a surface panel;

receiving, a the surface panel, the instruction for actuating the first ICV; and actuating, using the surface panel, the first ICV based on the instruction.

21. A non-transitory machine-readable storage medium comprising instructions that, when executed by one or more processors of a machine, cause the machine to perform operations comprising:

periodically capturing pressure data associated with the multilateral well using a plurality of downhole sensors;

dynamically determining a pressure gradient value associated with the multilateral well based on the periodically captured pressure data;

automatically controlling, using an inflow control valve (ICV) placed within a first lateral, a flow of a gas from a downhole natural gas source into the multilateral well based on the dynamically determined pressure gradient; and causing a lift of the fluid received from a second lateral within the well when the first ICV is open; and using the processor, comparing the dynamically determined pressure gradient value to a reference gradient value and, if a difference between the dynamically determined pressure gradient value and the reference gradient value is not greater than a predetermined pressure gradient tolerance, determines whether the first ICV is fully closed, wherein, if the processor determines that first ICV is fully closed:

the processor determines whether the difference between the dynamically determined pressure gradient value and the reference gradient value is within ten percent of the predetermined pressure gradient tolerance, and if the difference between the dynamically determined pressure gradient value and the reference gradient value is within ten percent of the predetermined pressure gradient tolerance, the processor records a choke size of the first ICV as an optimum choke size for controlling the flow of a gas from the downhole natural gas source into the multilateral well.

* * * * *